US006845827B2

(12) United States Patent
Richter et al.

(10) Patent No.: US 6,845,827 B2
(45) Date of Patent: Jan. 25, 2005

(54) ROCK DRILL HEAD

(75) Inventors: Martin Richter, Freising (DE); Udo Hauptmann, Landsberg/Lech (DE); Stefen Götzfried, Kleinkitzighofen (DE); Werner Kleine, Achim (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/318,930

(22) Filed: Dec. 12, 2002

(65) Prior Publication Data

US 2003/0116359 A1 Jun. 26, 2003

(30) Foreign Application Priority Data

Dec. 13, 2001 (DE) ..... 101 61 187

(51) Int. Cl.[7] ..... E21B 10/36; E21B 10/62
(52) U.S. Cl. ..... 175/419; 175/414; 175/320
(58) Field of Search ..... 175/320, 414, 175/415, 417, 419, 420, 300

(56) References Cited

U.S. PATENT DOCUMENTS 1,526,565 A * 2/1925 Redman ..... 279/22
2,059,496 A * 11/1936 Smith ..... 279/93
2,092,060 A * 9/1937 Gairing ..... 279/93
2,158,120 A * 5/1939 Hirschberg ..... 175/417
4,043,409 A * 8/1977 Walter ..... 175/321
4,474,488 A * 10/1984 Pinkerton et al. ..... 403/24
4,754,820 A * 7/1988 Watts et al. ..... 175/195
4,941,783 A * 7/1990 Maier ..... 408/204
6,021,855 A * 2/2000 Beccu et al. ..... 175/321

FOREIGN PATENT DOCUMENTS

DE 3130221 A1 * 6/1982 ..... B23B/41/02
EP 782840 A1 * 7/1997 ..... A61B/17/16
GB 2094853 A * 9/1982 ..... E21B/7/20
GB 2385869 A * 9/2003 ..... E21B/17/07

* cited by examiner

*Primary Examiner*—David Bagnell
*Assistant Examiner*—Shane Bomar
(74) *Attorney, Agent, or Firm*—Sidley Austin Brown & Wood, LLP

(57) ABSTRACT

A drill head for rock drilling comprising cutting edges (1) made of hard material, which is detachably connected axially, over a bearing surface (3), with a drilling shaft (4) with at least one radially projecting driver blade (5*a*, 5*b*, 5*c*) by a bayonet-type connection slot (6*a*, 6*b*, 6*c*), wherein at least one connection slot (6*a*, 6*b*, 6*c*) is present, which forms two axially opposing undercuts (7*a*, 7*b*), within which the driver blade (5*a*, 5*b*, 5*c*) has limited axial movement.

7 Claims, 1 Drawing Sheet

ROCK DRILL HEAD

BACKGROUND OF THE INVENTION

The invention relates to a drill head for an at least partially rotationally and percussively driven rock drill, in particular, for boring blasting holes for explosive charges.

Such drill heads set with cutting edges made of hard material for rock drills having a diameter of approximately 30 cm are, as wearing parts, detachably connected to the leading end of an at least partially rotationally and percussively driven drilling shaft of several meters length, which conventionally has a hollow flushing channel.

U.S. Pat. No. 6,021,855 discloses a drill head set with cutting edges made of hard material connected axially and freely moveable within a several millimeters limit to a hollow drilling rod, whereby an improved compressive pulse delivery into the rock is achieved.

DE 9308444U1 discloses a drill head connected with a drilling rod by a bayonet connection, wherein the drill head forms two radially projecting driver blades on a guide pilot, which engage in associated connection slots. The partially open axial stop of the connection groove on the drill head side is unusable for a limited axial free moveable drill head.

U.S. Pat. No. 4,043,409 discloses a potlike drill head set with cutting edges made of hard material axially resiliently damped and detachably connected by a bayonet connection with a hollow drilling shaft, wherein the drill shank forms at least two radially projecting driver blades, which engage in associated connection grooves and can be peripherally and axially displaced. Limited free axial movement is not possible due to the resiliently buffered drill head.

SUMMARY OF THE INVENTION

The object of the invention is to provide a limited axial freely moveable drill head that is detachably connected to the drill shaft.

The object is substantially achieved, in accordance with the invention, by a drill head set with cutting edges made of hard material, which, over a bearing surface, is axially detachably connected with a drilling shaft with at least one radially projecting driver blade by an associated bayonet-type connection groove, which has two axially opposing undercuts, within which the driver blade has limited axial movement within several millimeters.

By virtue of the two axially opposingly disposed undercuts in the bayonet-type connection groove, a limited axially free moveable drill head is securely connected to the drilling shaft upon turning in the same direction and upon turning in the opposite direction the drill head is released.

Preferably, the axial distance of the opposingly disposed undercuts is less than double the length of the axial length of the associated driver blade, whereby, despite limited axial movement of the driver blade, there is sufficient formal rigidity of the driver blade forming the bayonet connection and the connection groove required for transmission of torque.

Preferably, two driver blades and two associated bayonet-type connection grooves are present, whereby a substantially axial-symmetrical transmission of forces results.

Preferably, three driver blades and two associated bayonet-type connection grooves are present, whereby an extensively uniform bending stress results in a bending or flexural moment at the time of drilling.

Preferably, at least one second driver blade and/or a second connection groove is arranged varying with respect to shape and/or arrangement from an integer rotational symmetry, whereby the drill head is assignable to the drilling shaft exclusively in one position, in which the bayonet connection is fittingly compelled as a result of frictional wear and stiffening.

Preferably, the shape varies with regard to the width and/or the length of two connection grooves, which is technically uncomplicated to manufacture.

Preferably, in a potlike drill head, the connection grooves are configured radially open as slots, which is technically uncomplicated to manufacture.

SUMMARY OF THE INVENTION

The preferred exemplary embodiment of the invention will be more completely explained below with reference to the following drawings, wherein.

DETAILED DESCRIPTION OF THE INVENTION

Figure 1:
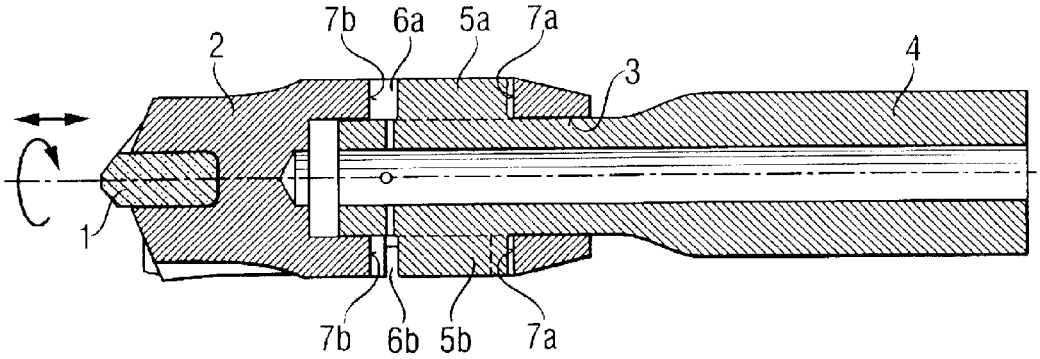
FIG. 1 shows a rock drill, in accordance with the invention.

FIG. 1 shows a cross-sectional view of a rock drill comprising a potlike drill head (2) set with cutting edges (1) made of hard material, which runs on peripheral inner bearing surfaces 3 axially. The drill head (2) is form-lockingly rotationally-fixed and detachably connected with two driver blades 5*a*, 5*b* with a hollow drill shaft 4 (only partially represented), at the head-end radially tapering, and two bayonet-type connection slots 6*a*, 6*b* associated with the driver blades 5*a*, 5*b*, within which the driver blade 5*a*, 5*b* has limited axial movement within several millimeters.

Figure 2:
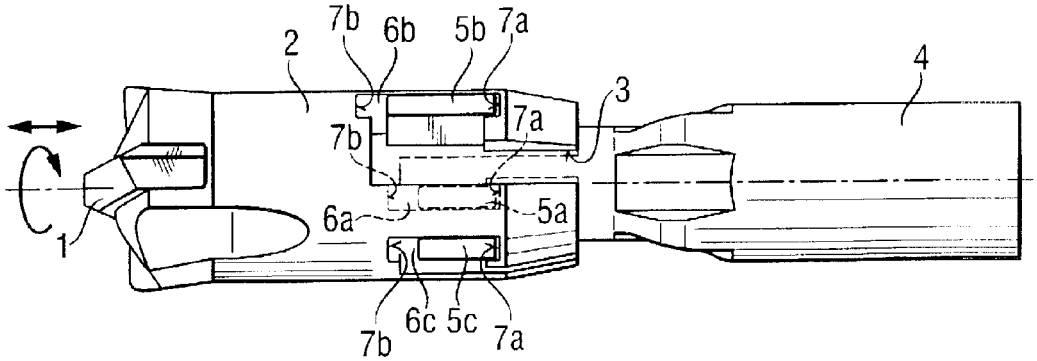
FIG. 2 shows a variant of the rock drill of FIG. 1.

FIG. 2 shows a variant of the rock drill of FIG. 1, having three radially open connection slots 6*a*, 6*b*, 6*c*, which are essentially peripherally off set by 120°, whereby the driver blade 5*a*, 5*b*, 5*c* and three associated, axially open, bayonet-type, radially open connection slots 6*a*, 6*b*, 6*c*, are present, on the shaft-side, in the counter-rotational direction. The driver blade 5*a* and the connection slot 6*a* are shown phantom, in the background of the drawing. The connection slot 6*b* forms two axially opposing undercuts 7*a*, 7*b* and differs in its length and width from the connection slot 6*c*. The axial distance of the opposing undercuts 7*a*, 7*b* is smaller than the doubled axial length of the associated driver blade 5*a*.

What is claimed is:

1. A drill head for rock drilling comprising hard cutting edges (1) and being detachably connected axially over a bearing surface (3) with a drilling shaft (4) with at least one radially projecting driver blade (5*a*, 5*b*, 5*c*) by an associated bayonet-type connection slot (6*a*, 6*b*, 6*c*), wherein at least one connection slot (6*a*, 6*b*, 6*c*) forms two axially opposing undercuts (7*a*, 7*b*) within which the driver blade (5*a*, 5*b*, 5*c*) has limited axial movement.

2. The drill head of claim 1, wherein the axial spacing of the opposing undercuts (7*a*, 7*b*) is less than double the axial length of the associated driver blades (5*a*, 5*b*, 5*c*).

3. The drill head of claim 1, comprising two driver blades of the at least one radially projecting driver blade (5*a*, 5*b*, 5*c*) and two associated bayonet-type connection slots of the at least one connection slot (6*a*, 6*b*, 6*c*).

4. The drill head of claim 1, comprising three driver blades (5*a*, 5*b*, 5*c*) and three associated bayonet-type connector slots (6*a*, 6*b*, 6*c*).

5. The drill head of claim 1, wherein the connection slots (6*a*, 6*b*, 6*c*) in a potlike drill head (2) are configured radially open as slots.

6. A drill head of claim 1, wherein at least one of a second driver blade (5*a*, 5*b*, 5*c*) and a second connection slot (6*a*, 6*b*, 6*c*) is arranged from an integer rotational symmetry with regard to a disposition.

7. The drill head of claim 6, wherein the shape of the two connection slots (6*a*, 6*b*, 6*c*) varies in at least on of the width and/ or the length.

* * * * *